US008591390B2

(12) United States Patent
Spiers

(10) Patent No.: US 8,591,390 B2
(45) **Date of Patent: *Nov. 26, 2013**

(54) VERTICAL FILTER FILLING MACHINE AND PROCESS

(75) Inventor: Steven F. Spiers, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 926 days.

This patent is subject to a terminal disclaimer.

(21) Appl. No.: 12/173,941

(22) Filed: Jul. 16, 2008

(65) Prior Publication Data

US 2009/0036284 A1 Feb. 5, 2009

Related U.S. Application Data

(60) Provisional application No. 60/952,699, filed on Jul. 30, 2007.

(51) Int. Cl.
*B31C 99/00* (2009.01)
*B31C 11/00* (2006.01)

(52) U.S. Cl.
USPC ..... 493/47

(58) Field of Classification Search
USPC ..... 493/39, 45, 47, 48, 50; 131/29, 61.1, 131/76, 88, 94, 341, 342, 344, 70–75, 131/111–119
See application file for complete search history.

(56) References Cited

U.S. PATENT DOCUMENTS

| | | | |
|---|---|---|---|
| 3,517,480 | A | 6/1970 | Pinkham |
| 3,603,058 | A | 9/1971 | Schubert et al. |
| 5,135,008 | A | 8/1992 | Oesterling et al. |
| 2002/0119874 | A1 | 8/2002 | Heitmann et al. |
| 2003/0131856 | A1 | 7/2003 | Dombek |
| 2005/0094014 | A1 | 5/2005 | Haas et al. |
| 2006/0112963 | A1 | 6/2006 | Scott et al. |

*Primary Examiner* — M. Alexandra Elve
*Assistant Examiner* — John Paradiso
(74) *Attorney, Agent, or Firm* — Roberts Mlotkowski Safran & Cole, P.C.

(57) ABSTRACT

A process and apparatus for the mass production of compound cigarette filters function to deposit granular filter material into the open ends of vertically oriented filter tubes. Predetermined amounts of diverse granular material are withdrawn by suction from sources of such material, and these amounts are deposited into the tubes. Solid filter segments seal the granular material within the tube. After one half of each filter tube is filled with granular material and sealed, the tube is inverted and the opposite end is filled in substantially the same manner. When cut in half each filter tube produces two cigarette filters.

22 Claims, 7 Drawing Sheets

100
112,114
140
142
138
136
204
210
200
202
206
208
158
126
128
130
146
144
156
154
152
150
148
170
160
118
119
157
134
132
151
120
122
124
116

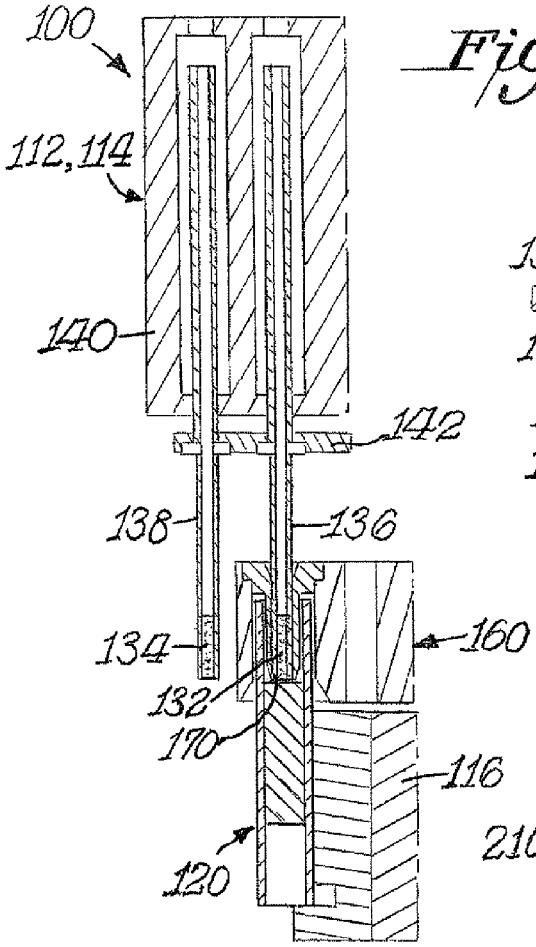
Fig. 4.
Fig. 6.
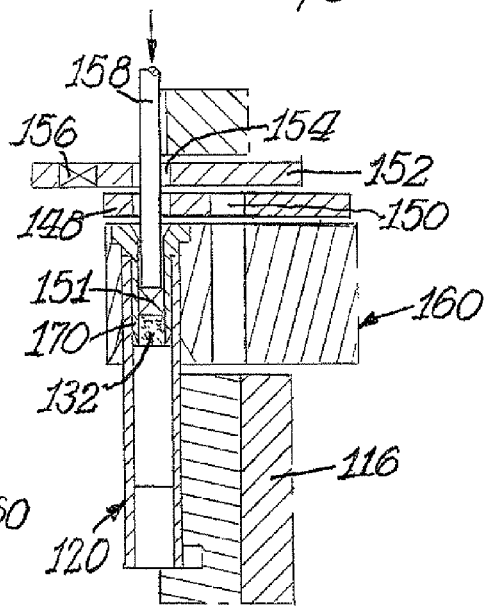
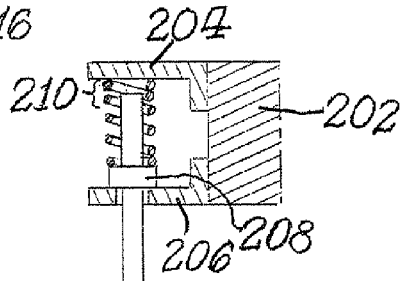
Fig. 5.
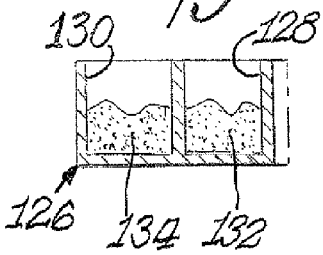
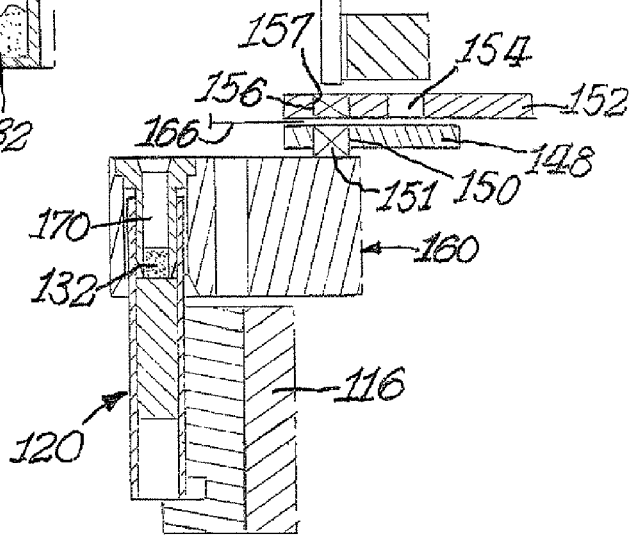

Fig.20.
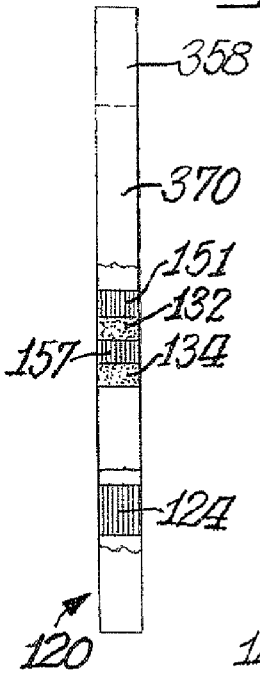
Fig.21.
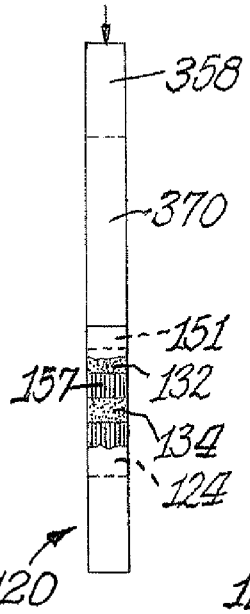
Fig.22.
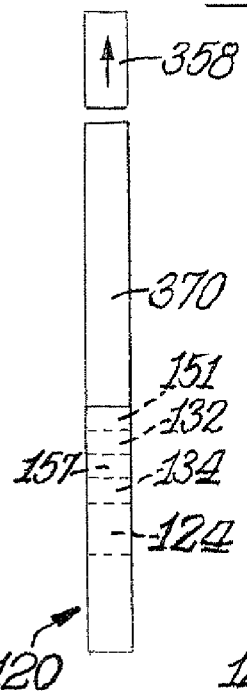
Fig.23.
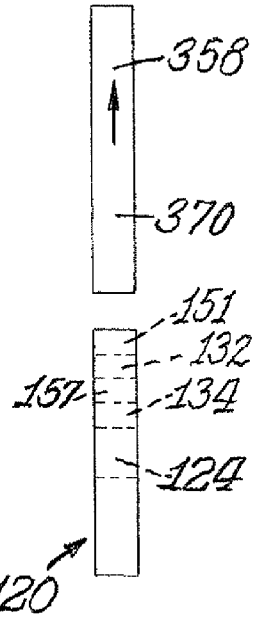
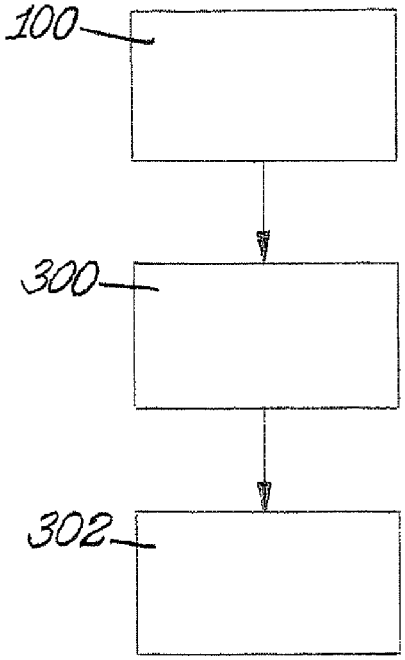
Fig.25.

VERTICAL FILTER FILLING MACHINE AND PROCESS

CROSS REFERENCE RELATED TO APPLICATION

The present application claims the benefit of provisional application Ser. No. 60/952,699, filed Jul. 30, 2007, for all useful purposes, and the specification and drawings thereof are included herein by reference.

BACKGROUND OF THE INVENTION

U.S. Pat. Nos. 3,517,480 and 3,603,058 illustrate and describe machines for the production of composite cigarette filters by directly flowing granular filter material from a storage hopper into a vertically oriented filter tube made of paper. Similarly, US Patent Application Publication 2002/0119874A1 describes another machine for producing compound cigarette filters that includes a series of rotating plates with cavities therein into which the granular filter material is deposited. The cavities ultimately are aligned with an open paper ended filter tube to facilitate deposit of the granular material into the tube. These machines have the disadvantage of often destroying the integrity of the paper filter tubes into which filter materials are deposited. They also deposit imprecise amounts of granular material and produce undesired amounts of fine dust and the like.

US Patent Application Publication 2006/0112963 discloses a process and apparatus for producing compound cigarette filters which preserve the integrity of the paper filter tubes of cigarette filters and provide precise deposition of granular material into the filters. The process and apparatus function to deposit granular filter material into the open ends of vertically oriented filter tubes. Predetermined amounts of diverse granular material are withdrawn by suction from sources of such material, and these amounts are deposited into the tubes. Solid filter segments seal the granular material within the tube. After one half of each filter tube is filled with granular material and sealed, the tube is inverted and the opposite end is filled in substantially the same manner. When cut in half, each filter tube produces two cigarette filters. Further improvements over the process and apparatus of US Patent Application Publication 2006/0112963 are desired.

SUMMARY OF THE INVENTION

Accordingly, one of the objects of the present invention is a vertical filter filling machine and process for producing multiple cavity cigarette filters in a highly efficient and economical manner at high rates of production.

Another object of the invention is a vertical filter filling machine and process having the ability to assemble very small filter components less than three millimeters in length.

Another object of the invention is a vertical filter filling machine and process for producing multiple cavity cigarette filters which includes precise dosing of reduced smoking constituent materials and/or flavoring materials.

Still another object of the invention is a vertical filter filling machine and process for producing compound cigarette filters with minimal or no cross contamination of filter material whereby extremely clean filters are produced.

Another object of the invention is a vertical filter filling machine and process for producing compound cigarette filters with precise dosing of granular material while eliminating granular material scatter on the filters being produced at extremely high production rates. Also, among the objects of the invention is maintaining the integrity of the paper filter tubes when filling the tubes with granular materials and discrete solid filter segments.

Yet another object of the invention is to ensure that filters are produced such that there are no gaps between the filter materials.

In accordance with an embodiment of the invention a preformed filter tube of paper with hollow ends and a solid center of cellulose acetate or similar material is formed into two multiple cavity cigarette filters. The filter tube is aligned with an alignment tube which rotates in a circular path together with the filter tube, and the first open end of the filter tube is placed over the alignment tube such that the alignment tube is inserted into the filter tube. Thereafter, a metered amount of granular filter material and a plug of cellulose acetate or similar material for sealing the granular material are deposited in the alignment tube. The granular material(s) and plug (s) form filling materials for the filter tube. A second metered amount of different granular filter material as well as a second plug to seal that material may also be deposited in the alignment tube. Subsequently, the collective filling materials are pushed into the filter tube from the alignment tube. Thereafter, the filter tube is inverted and the remaining half is filled with at least one granular material and a corresponding sealing plug in the same manner.

Cutting the tube midway through the solid center thereof produces two individual multiple cavity cigarette filters.

Specifically, the process of producing compound cigarette filters according to an embodiment of the invention comprises the steps of placing a filter tube with hollow ends and a solid filter center in a substantially vertical position, aligning the filter tube with an alignment tube and placing the first open end of the filter tube over the alignment tube such that the alignment tube is inserted into the filter tube. A predetermined amount of granular material is withdrawn by suction from a source of such material, and the predetermined amount of material is deposited into the alignment tube. Next, a solid filter segment is placed into the alignment tube directly against the granular material to thereby seal the granular material in place. The granular material and plug thus form filling materials to be inserted into the filter tube. Thereafter, the filling materials are inserted into the upper open end of the filter tube directly against the solid center.

Throughout the entire filling process, the integrity of filter tube, usually made of thin easily crumpled paper, is maintained by initially depositing all of the filling materials into the internal alignment tube placed within the filter tube, and then pushing the filling materials directly into the filter tube without any significant relative movement between the filling materials and the interior walls of the filter tube. Moreover, as the filling materials exit the internal alignment tube into the filter tube, the filter tube moves in a downward direction at a speed that matches the downward speed of the filter contents. This coordinated movement prevents sliding of the filling materials against the inside surface of the filter tube which might otherwise cause the filter tube to wrinkle or buckle. Additionally, by inserting all of the filling materials into the filter tube at one time, gaps between the filter contents in the filter tube are avoided.

Furthermore, predetermined amounts of a second granular material may be withdrawn by suction from sources of such material and deposited into the alignment tube, directly against the solid filter segment already in place. A second solid filter segment may then be placed into the alignment tube directly against the second granular material to thereby seal the second granular material in place, thus providing filling materials including two types of granular materials, each sealed by a corresponding plug.

The process also includes inverting the filter tube and filling the other open end of the tube with granular material(s) and solid filter segment(s) in the same manner as the first open end.

Moreover, the solid filter segments placed against the granular material may be produced from an extended solid filter segment which is sliced into two pieces during the process to thereby produce each of the two solid filter segments. Both the solid filter center and solid filter segments may comprise cellulose acetate tow.

In accordance with this embodiment, an apparatus for producing compound cigarette filters comprises a rotating tube flute plate for holding and transporting a plurality of filter tubes along a circular path. Each filter tube has opposite hollow ends and a solid filter center, and the tubes are held by suction in vertically orientation flutes on the tube flute plate. A rotating alignment plate includes a plurality of internal alignment tubes. The first open ends of the filter tubes are placed over the alignment tubes. A plurality of vertically oriented fill tubes with suction applied thereto withdraw predetermined amounts of granular material from a rotating bin of such material and deposit one predetermined amount into the alignment tubes upon termination of the suction on the fill tubes. A rotating segment plate holds a plurality of solid filter segments, and a plurality of rotating plungers vertically push the solid filter segments out of the segment plate into the alignment tubes directly against the granular material in the alignment tubes to form filter contents to be inserted into the filter tubes. After the filter contents have been placed inside the alignment tubes, the plungers push the filter contents into the first open ends of the filter tubes, directly against the solid filter centers.

The integrity of the filter tubes is maintained throughout the filling process by initially placing all of the filling materials into the internal alignment tubes and then pushing those materials out of the alignment tubes after the filter tubes are placed over the alignment tubes, and in doing so using the aforementioned coordinated movement to avoid relative motion between the materials being pushed and the paper tubes which receive the pushed materials. Additionally, by inserting all of the filling materials for each half of a filter into the filter tube together at one time, gaps between the filter contents are avoided.

Preferably, in forming the filter contents, a second plurality of vertically oriented fill tubes with suction applied thereto withdraw predetermined amounts of a second granular material from the rotating bin. A predetermined amount of the second granular material is deposited into the alignment tubes directly against the solid filter segment already in place upon termination of the suction on the second fill tubes. A rotating second segment filter plate holds a plurality of second solid filter segments and the plurality of plungers vertically push the second solid filter segments out of the second filter segment plate into the alignment tubes to complete formation of the filling materials for the first half of the filter tube.

The rotating bin of granular material preferably includes several compartments with each compartment containing a different granular material.

Preferably the rotating tube flute plate, the rotating bin of granular material, the plurality of vertically orientated fill tubes and second fill tubes, the rotating filter segment plate and second filter segment plate, and the plurality of rotating plungers collectively comprise an upper wheel assembly rotating about a central vertical axis. A substantially identical lower wheel assembly also rotates about the same central vertical axis. A conveyor system removes half filled filter tubes from the upper wheel assembly, inverts the tubes and places them on the rotating tube flute plate of the lower wheel assembly. The other ends of the filter tubes are then filled with granular material and solid filter segments on the lower wheel assembly.

In the apparatus of the invention a segment flute plate holds a plurality of extended length solid filter segments. A rotating cutter moveable between the solid filter segment plate and the second solid filter segment plate cuts the extended length solid filter segment after positioning thereof in the solid segment plate and the second solid segment plate to thereby form the solid filter segments and the second solid filter segments.

According to an alternate embodiment, a method for producing compound cigarette filters comprises preparing filling materials by pushing a first filter segment into an assembly tube from below with a lower plunger and applying vacuum through an upper plunger at the top of the assembly tube to draw a first granular material into the assembly tube against the first filter segment, and thereafter positioning a filter tube over a bottom end of the assembly tube and pushing the filling materials with the upper plunger so as to insert filling materials into the filter tube.

Preparing the filling materials may also include pushing a second filter segment into the assembly tube and against the first granular material with the lower plunger and applying vacuum through the upper plunger at the top of the assembly tube to draw a second granular material into the assembly tube against the second filter segment.

The filter tube may be moved downward at the same rate as the upper plunger as the filling materials are inserted in the filter tube in order to prevent the filter tube from buckling or wrinkling.

According to the alternate embodiment, an apparatus for producing compound cigarette filters comprises a hollow assembly tube, a hollow upper plunger having a perforated end and a lower plunger. The lower plunger moves up to push a first filter segment into the assembly tube from below the assembly tube. The upper plunger is inserted in the assembly tube from above to draw a first granular material from a granule bin into the assembly tube against the first filter segment. Thus, filling materials for the cigarette filter are prepared. A filter tube is placed over the bottom end of the assembly tube. Thereafter, the upper plunger moves down to push the filling materials out of the assembly tube into the filter tube.

To further prepare the filling materials, the lower plunger may move up to push a second filter segment into the assembly tube against the first granular material and the upper plunger and vacuum may be applied through the upper plunger at the top of the assembly tube to draw a second granular material into the assembly tube against the second filter segment.

The apparatus may move the filter tube downward at the same rate as the upper plunger as the filling materials are inserted in the filter tube in order to prevent the filter tube from buckling or wrinkling.

The method and apparatus of the alternate embodiment provide for tight packing of filling materials in the filter tube by eliminating gaps between the filling materials. The integrity of the filter tubes is also preserved by minimizing relative motion between the filling materials and the filter tube as the filling materials are placed in the filter tube. Furthermore, this embodiment provides for precise metering of the granular filter materials by allowing fill amounts to adapt to variations in the lengths of the filter segments in the filter tubes.

In accordance with the invention, the multiple cavity dual filters may be removed and directly delivered to a tipping machine where wrapped tobacco rods at both ends of the filter are attached with tipping paper. Cutting the filter in half produces two cigarettes. This arrangement eliminates the need to store and deliver the dual filters to a distant tipping machine.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which:

FIG. 4 is a diagrammatic sectional view taken along process plane 4 of FIG. 1 where the tube flute plate has moved up to its stop position and completely inserted the filter tube into the alignment plate and over an internal alignment tube; the tube flute plate, filter tube and alignment plate have moved radially out to a stop position which positions the filter tube in vertical alignment with the inner fill tube; and the fill tubes have moved axially down and the inner fill tube is inside the alignment tube for deposit of the granular material from the inner fill tube into the alignment tube;

FIG. 5 is a diagrammatic sectional view where the granules from the inner fill tube have been deposited in the alignment tube, the plunger has pushed the filter segment through a second segment plate into a first segment plate and into contact with the surface of the alignment plate and the extended filter segment has been cut into upper and lower filter segments;

FIG. 6 is a diagrammatic sectional view where the plunger moves down to thereby push the lower filter segment against the granular material in the alignment tube;

FIG. 20 is a diagrammatic, partially sectional view of the alternative embodiment where the filter tube is fitted onto the assembly tube from below in preparation for pushing the filling materials from the assembly tube into the filter tube;

FIG. 21 is a diagrammatic, partially sectional view of the alternative embodiment where the upper plunger is moving axially down and the filter tube is moving down at the same rate, such that the filling materials are pushed out of the assembly tube into the filter tube;

FIG. 22 is a diagrammatic view of the alternative embodiment where the filling materials have been inserted into the filter tube and the upper plunger is retracting up and out of the assembly tube;

FIG. 23 is a diagrammatic view of the alternative embodiment where the assembly tube is retracting up to allow removal of the filter tube from the assembly tube;

FIG. 25 is a simple diagrammatic view illustrating the concept of cigarette assembly immediately downstream from the vertical filling machine without the need for storing the filters.

DETAILED DESCRIPTION OF THE INVENTION

Published application U.S. 2006/0112963 A1, the entire disclosure of which is incorporated herein by reference for all useful purposes, illustrates embodiments of a vertical filter filling machine. The invention disclosed herein provides further embodiments beyond the invention disclosed in application U.S. 2006/0112963 A1.

Figure 24:
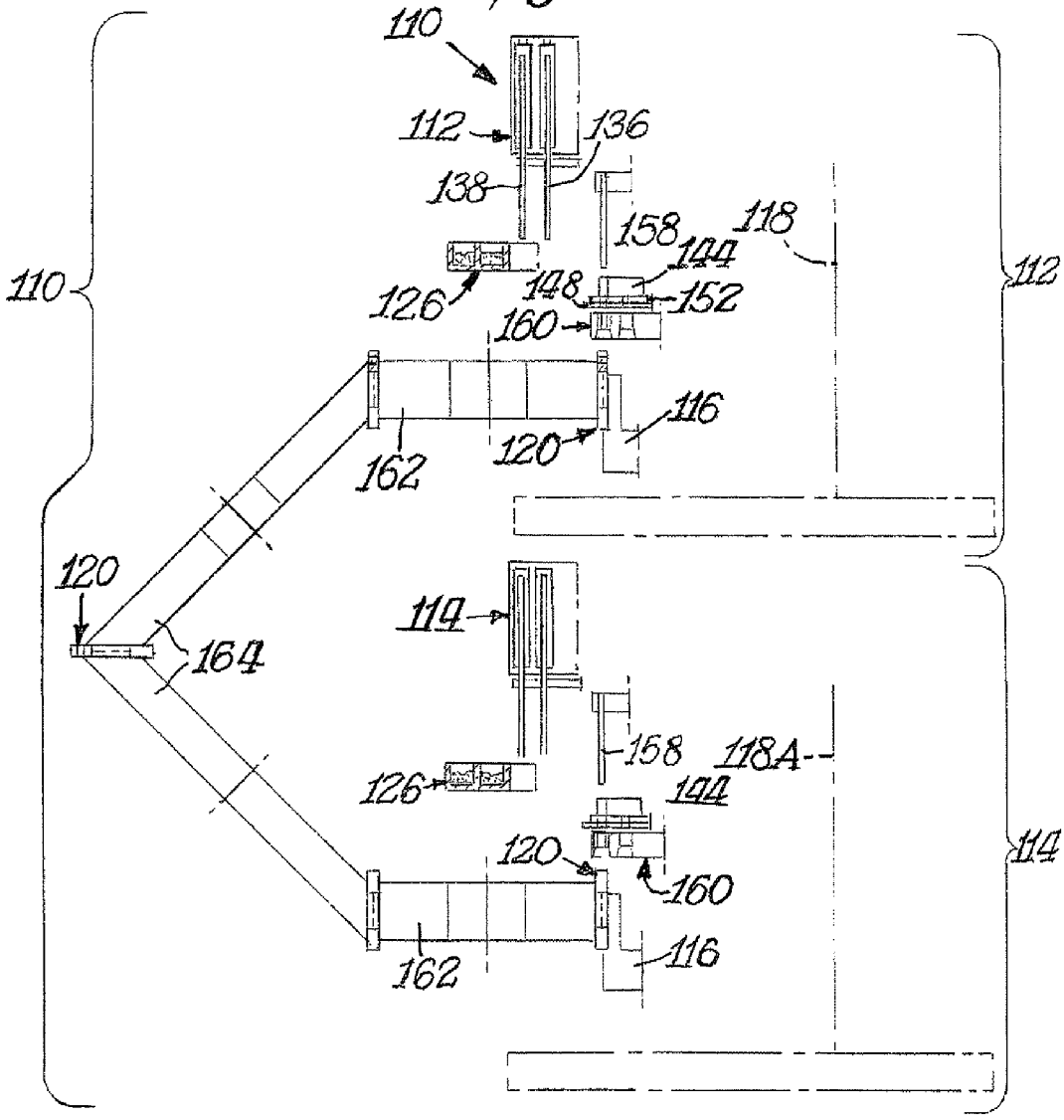
FIG. 24 is a diagrammatic sectional view of a vertical filling machine according to the embodiment of FIGS. 1-9, where then filter tube is inverted by a series of bevel and cylindrical transfer drums and transported to a second wheel assembly that repeats the process steps shown in FIGS. 3-9 to thereby complete filter tube assembly of he second half of the filter tube.

Referring in more particularity to the drawings, FIG. 24 shows a vertical filter filling machine 100 according to one embodiment of the invention, wherein the vertical filling machine 100 includes an upper wheel assembly 112 and a lower wheel assembly 114. Essentially the upper wheel assembly functions to fill the upper half of a filter tube with granular material and solid filter segments while the lower wheel assembly 114 fills the lower half of the filter tube with granular material and solid filter segments. The upper and lower wheel assemblies 112, 114 of the vertical filter filling machine 100 of the present invention are substantially identical in design and function and each includes a number of key components. Operation of the machine 100 forms filter tubes 120 (FIG. 1) including a hollow cylindrical paper tube 122, a solid filter center 124, first and second granular materials 132, 134 and first and second filter segments 151, 157.

Figures 1, 2, 3:
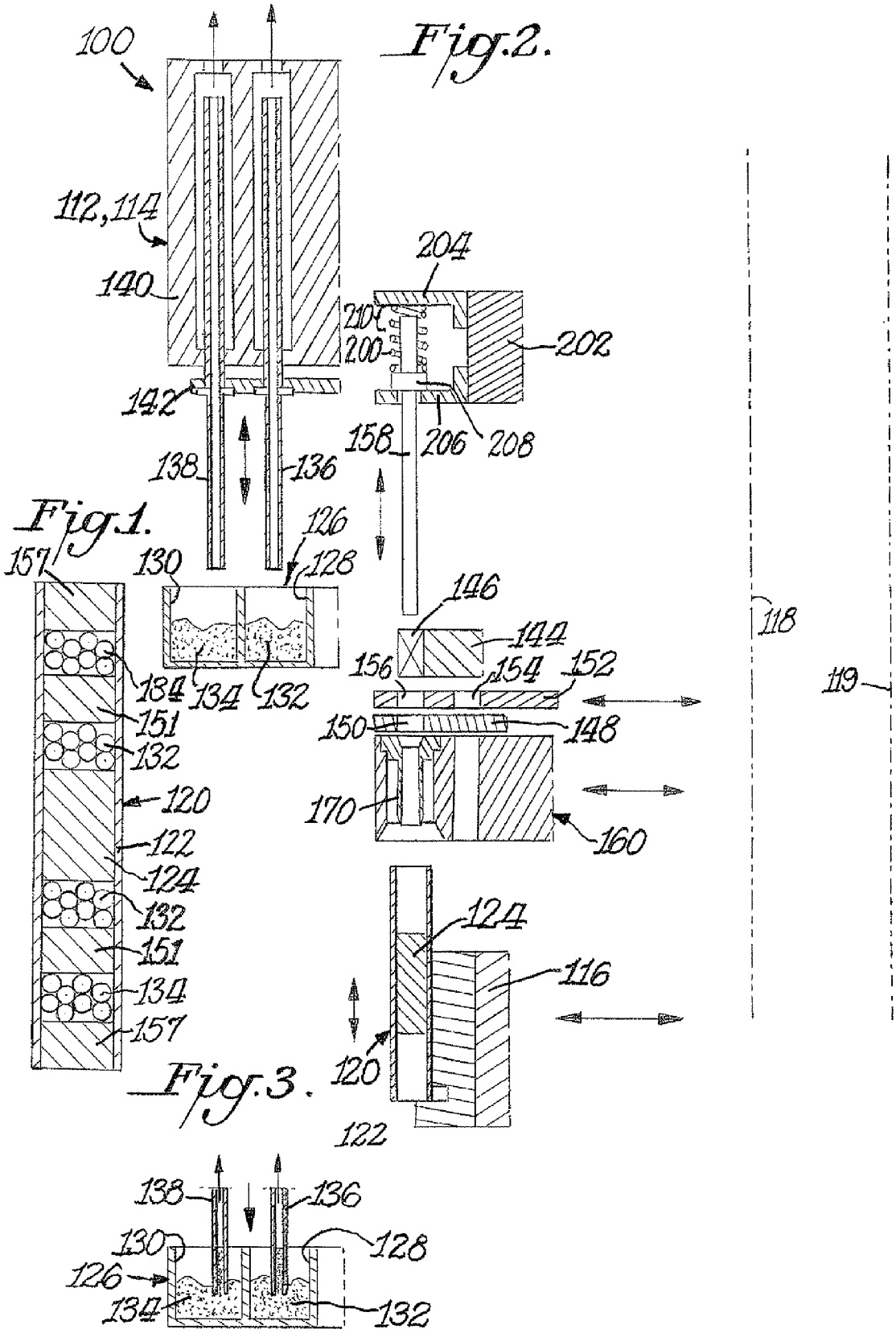
FIG. 1 is a diagrammatic cross-sectional view of a filter tube produced according to the invention.
FIG. 2 is a diagrammatic general cross sectional view illustrating the various components of an assembly station according to one embodiment of the invention, as well as the direction of movement of each component, where the filter tubes are on a tube flute plate and the filter segments are on a segment flute plate.
FIG. 3 is a diagrammatic sectional view showing fill tubes and granule bins of the assembly station of FIG. 2, wherein the fill tubes have moved down into granular material in the granule bin and vacuum has drawn the granular material into the tubes.

Referring now also to FIG. 2, one of the key components of the machine 100 comprises a tube flute plate 116 that rotates about a central axis 118 of each wheel assemblies 112, 114. The flutes of tube flute plates 116 receive an detain filter tubes 120, each of which comprises a hollow cylindrical paper tube 122 with a solid filter center 124 such as a plug of cellulose acetate tow, or filter paper or other material including non-fibrous materials such as plastics. The filter tube when both ends are filled with granular material and solid filter segments forms a two-up dual filter (FIG. 1) which when combined with wrapped tobacco rods at each end thereof ultimately produces two complete cigarettes. When cut through the middle of the solid filter center, the cigarette filter has a length of approximately 30 mm, but can be shorter or longer, if desired. As explained more fully below, the tube flute plate with the filter tubes secured thereto by vacuum moves in both axial and radial directions during the production of the filter.

Another key component of the vertical filter filling machine 100 comprises a rotating bin 126 of granular material having inner and outer troughs 128, 130 of different granular material 132, 134. The granular bin rotates off center during filter formation so that the bin is outside of several fill tubes 136, 138 which allows these tubes to move axially down for deposit of granular material into the filter tubes 120.

All machine elements that are shown in FIG. 2, except for the granular material bin 126, rotate about the axis 118 and are common to each of a plurality of assembly wheel stations. There are fifteen assembly wheel stations in a preferred embodiment. The material bin 126 rotates at a slightly different speed as the other elements, and about a different axis 119 that is offset from axis 118 so that the material bin 126 and the fill tubes 136 and 138 come into vertical alignment for a portion of their rotation as they rotate during a cycle.

The rotational speeds of the material bin 126 and the fill tubes 136, 138 differ to ensure that the fill tubes 136, 138 pick up material from the material bin 126 at different locations along the material bin 126 from cycle-to-cycle.

The fill tubes 136, 138 together with a vacuum wheel 140 and a fill tube support 142 cooperate with the granular bin 126 for withdrawing and depositing granular material 132, 134 into the upper open end of the vertical filter tubes 120. The vacuum wheel 140 rotates about central axis 118 and functions to supply vacuum to the inner and outer fill tubes 136, 138. The fill tubes 136, 138 rotate with the vacuum wheel 140 about the axis 118, and the fill tubes are attached to the fill tube support 142 for axial movement with the tube support. The internal volume of the fill tubes controls the volume of granular material withdrawn into the tube. Each tube may include an adjustable internal stop for varying the volume by moving the stop closer to or further away from the open end of the tube. The stop is constructed to allow vacuum to pass therethrough, but does not allow the granular material to pass. The stop may comprise an internal, adjustable rod having slight clearance between it and the inner diameter of the fill tube.

An additional key element of the vertical filter filling machine 100 includes a segment flute plate 144 that rotates about the central axis 118. The segment flute plate 144 functions to hold extended length solid filter segments 146 before these segments are cut into two pieces and deposited into the filter tube 120 to seal the granular material in the tubes, as explained more fully below.

Another key element is a first segment plate 148 which also rotates about central axis 118. The first segment plate has a single opening 150 for receiving a first filter segment 151, explained more fully below.

The first segment plate 148 cooperates with a second segment plate 152 which also rotates about the central axis 118. The second segment plate 152 has inner and outer openings 154, 156, and this segment plate moves in a radial direction during filling of the filter tube 120. The outer opening 156 holds a second filter segment 157 while the inner opening allows a plunger 158 to pass there-through when inserting the first filter segment 151 into the filter tube 120. The plunger 580 also rotates about the vertical axis 180 and moves in an axial direction for pushing the solid filter segments 151, 157 into the filter tube 120. The upper end of the plunger 158 is secured to a plunger support plate 202 between an upper plunger stop bracket 204 and a lower plunger guide bracket 206. The plunger 158 includes a collar 208 secured thereto, and a compression spring 200 extends between the plunger stop bracket 204 and the collar 206 urging the plunger in a downward direction. The arrangement is such that the vertical movement of the plunger 158 relative to the plunger support plate 202 is limited to the distance 210.

The vertical filter filling machine 110 further includes an alignment plate 160 which also rotates about the vertical central axis 118. The function of the alignment plate is to receive the upper end of the filter tube 120 and thereby align the tube with the segment receiving openings in the first and second segment plates 148, 152. Within the alignment plate is an internal alignment tube or horn 170 which protects the inner walls of the filter tube 120 and maintains the integrity of the tube which is usually made of thin rather flimsy paper. The alignment tube or horn 170 prevents the filter tube 120 from wrinkling and/or buckling during the filling operation.

Preferably, the upper and lower wheel assemblies 112, 114 each include fifteen subassemblies and each subassembly includes twelve filter tubes 120 thereby producing one-hundred and eighty half-filled filters upon each revolution of the upper wheel assembly. The half-filled filters then transfer to the lower wheel assembly which functions to fill the other half of the filter tube. At production speeds of thirty revolutions per minute approximately 5,400 filters are produced each minute by the machine 100.

As shown in FIG. 2, filter tubes 120 each comprising a hollow paper tube 122 with a solid filter center 124 of cellulose acetate are loaded onto the outside flutes of the tube flute plate 116 of machine 110. Suction applied to the flutes of plate 116 hold the filter tubes 120 in vertical position on the outer circumference of the tube flute plate. Additionally, the extended length solid filter segments 146 are held on segment flute plate 144 by suction. The transfer of the filter tubes 120 and filter segments 146 onto the tube flute plate 116 and segment flute plate 144 may be accomplished by external transfer drums (not shown) using known drum technologies.

In the operation stage shown in FIG. 3, the fill tubes 136, 138 are moved downwardly into the granular materials 132, 134 within the troughs 128, 130 of the rotating off-center granular material bin 126. Vacuum from the vacuum wheel 140 withdraws a predetermined amount of material 132 into inner fill tube 136 while a predetermined amount of material 134 is drawn into the outer fill tube 138. As an alternative to granular material, gels may be placed in one or both of the troughs 128, 130, and the fill tubes may be arranged to withdraw predetermined amounts of such gels. Also, premeasured capsules of gels and other material may be individually positioned in the fill tube for subsequent deposit into the filter tube.

In a subsequent stage in the operation, which can be appreciated from the features shown in FIG. 2, the fill tubes 136, 138 with loaded granular materials therein move in an upward direction so that both tubes clear the top of the bin 126. At the same time the tube flute plate 116 moves in an upward direction so that the filter tube 120 enters and is aligned by the alignment plate 160 and the internal alignment tube 170. Simultaneously with the upward movement of the filter tube 120 into the alignment plate 160, both the alignment plate 160 and the tube flute plate 116 move outwardly in a radial direction.

Next, referencing the movement capabilities illustrated in FIG. 2, the tube flute plate 116 moves up to its uppermost stop position and the filter tube 120 is completely inserted into the filter tube opening in the alignment plate 160 and around the internal alignment tube or horn 170. At this point, the tube flute plate 116, filter tube 120 and alignment plate 160 move radially out to a stop position which places the alignment tube 170 and the open end of the filter tube 120 in vertical alignment with the inner fill tube 136. During the movement to align the filter tube 120 with the inner fill tube 136, the plunger 158 pushes the extended length segment 146 into and through the outer opening 156 in the second segment plate 152 and into the opening 150 in the first segment plate 148 until the filter segment 146 engages the top surface of the alignment plate 160.

Thereafter, as can be envisioned in view of FIG. 2, the internal vacuum on the segment flute plate 144 is terminated and the plunger 158 moves up and out of contact with the filter segment 146. Also, due to the off-center axis of the rotating bin 126, the cross-section of the bin at this location is out beyond the vertical path of the fill tubes 136, 138 and the fill tube support 142. At the next step, the extended length filter segment 146 is cut into two pieces by a rotary knife 166 (FIG. 6) which enters between the first and second segment plates 148, 152.

FIG. 4 illustrates a subsequent phase in the sequence of operation of the vertical filter filling machine 110. As shown in FIG. 4, filter tube 120 remains completely inserted into the filter tube opening in the alignment plate 160 and around the internal alignment tube or horn 170, and the fill tubes 136, 138 have moved axially down such that the inner fill tube 136 is inside the alignment tube 170. Vacuum wheel 140 which holds the granular material 132 in the inner fill tube 136 has been turned off and the granular material 132 flows into the alignment tube 170. Positive air pressure can be used to increase granular flow from the inner fill tube 136.

FIG. 5 shows the assembly 112 in a phase following the phase shown in FIG. 4, where the granular material 132 has been deposited in the alignment tube 170, the fill tubes 136, 138 have moved upward such that the inner fill tube 136 has been removed from the alignment tube 170 and the fill tubes 136, 138 have cleared the alignment plate 160, and the plunger 158 has retracted upward. The upper and lower cut portions 157, 151 of the filter segment 146 are retained in the second segment plate 152 and the first segment plate 148, respectively.

As can be visualized from the illustration in FIG. 2, following the stage shown in FIG. 5, the second segment plate 152 with the upper cut portion of the filter segment 146 moves radially out until the inner opening 154 of the second segment plate 152 is in line with the plunger 158 and the lower cut portion of the filter segment 151 in opening 150 of the first segment plate 148. Then, the filter tube 120, alignment plate 160, and tube flute plate 116 move radially in to a stop position where the alignment tube 170 and filter tube 120 are in line with the plunger 158, the inner opening 154 of the of the second segment plate 152 and the lower cut portion of the filter segment 151 in the first segment plate 148.

In the next sequence shown in FIG. 6 the plunger 158 moves in a downward direction and pushes the lower filter segment portion 151 into the alignment tube 170 against the granular material 132. The lower filter segment portion 151 is slightly compressed as it moves through the internal alignment tube 170. Since the lower filter segments 151 is forced through the alignment tube 170, the compression spring 200 of the plunger contracts until the top surface of the plunger contacts the plunger stop bracket 204. A gap (not shown) now exists between the collar 208 and the plunger guide bracket 206. Solid contact between the upper end of the plunger 158 and the plunger stop bracket 204 forces the first solid filter segment 151 to slide down the inner surface of the alignment tube 170.

Next, the plunger 158 retracts upward out of the alignment tube 170 and the tube flute plate 116, filter tube 120 and alignment plate 160 move radially out to a stop position which places the alignment tube 170 and the open end of the filter tube 120 in vertical alignment with the outer fill tube 138. The fill tubes 136, 138 then move axially down such that the outer fill tube 138 is inside the alignment tube 170. Vacuum wheel 140 which holds the granular material 134 in the outer fill tube 138 has been turned off and the granular material 134 flows into the alignment tube 170 against the first filter segment 151. Positive air pressure can be used to increase granular flow from the outer fill tube 138. At this time, the second segment plate 152 with the upper filter segment portion 157 has moved radially in until the upper filter segment portion 157 is in line with the plunger 158. After the granular material 134 has been deposited in the alignment tube 170 against the lower filter segment 151, the fill tubes 136, 138 move upward such that the outer fill tube 138 is removed from the alignment tube 170 and the fill tubes 136, 138 clear the alignment plate 160. Although not explicitly shown, these movements and functions can be appreciated by referencing FIG. 2.

Figure 7:
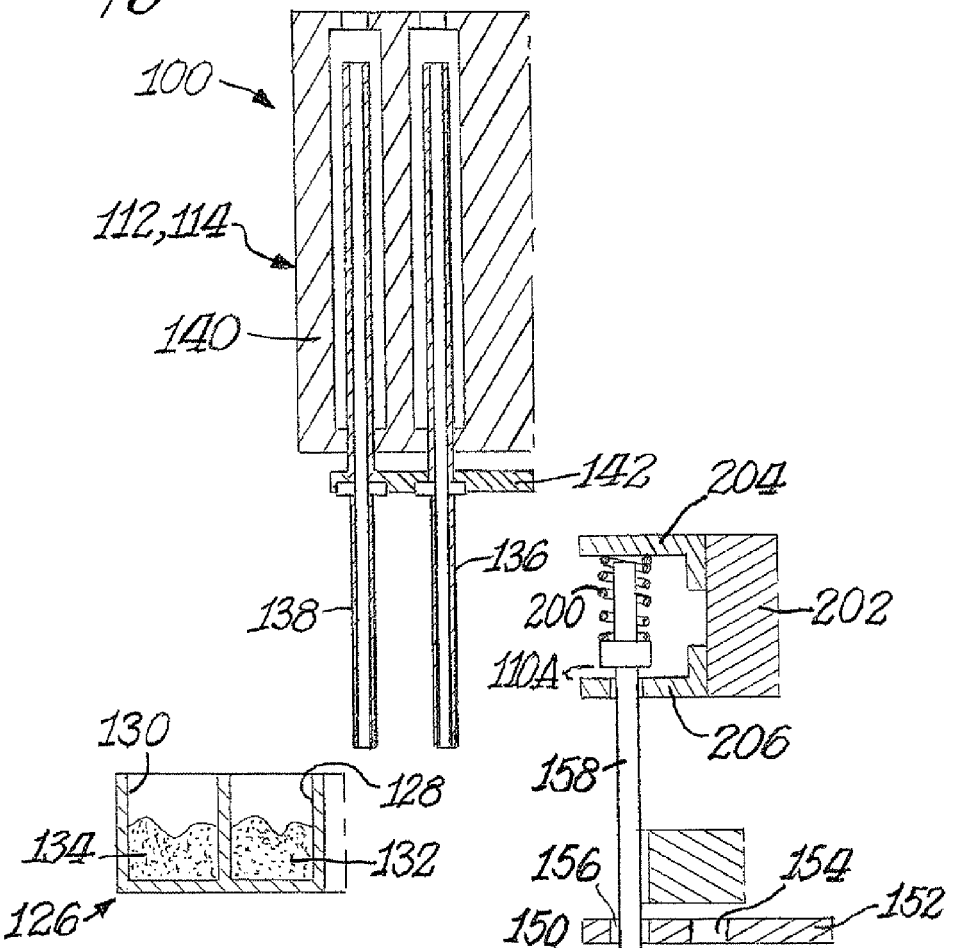
FIG. 7 is a diagrammatic sectional view where, after second granular material in the outer fill tube has been deposited into the alignment tube, the plunger has pushed the upper portion of the cut filter segment through the second segment plate and the first segment plate into the alignment plate.

FIG. 7 shows the next steps whereby the upper filter segment portion 157 is inserted into the alignment tube 170.

Specifically, the filter tube 120, alignment plate 160 and tube flute plate 116 have moved radially in to a stop position where the alignment tube 170 and the filter tube 120 are in alignment with the plunger 158 and the upper filter segment portion 157 in the second segment plate 152. The plunger 158 then moves down and pushes the second filter segment portion 157 through the opening 50 in first segment plate 148 and into the alignment tube 170 against the granular material 134. Gap 210A exists between the collar 208 and the plunger guide bracket 206 because the force required to the upper filter segment portion 157 through the alignment tube 170 causes contraction of the spring 200. Solid contact between the upper end of the plunger 158 and the plunger stop bracket 204 forces the first solid filter segment 151 to slide down the inner surface of the alignment tube 170.

Figure 8:
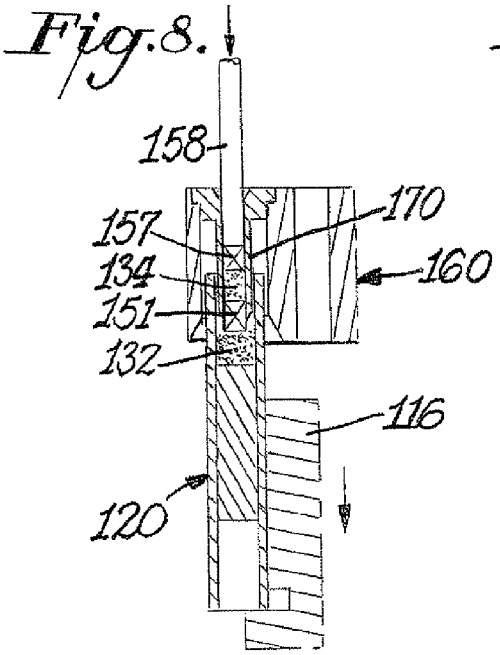
FIG. 8 is a diagrammatic sectional view where the plunger is moving down to push the filter materials out of the alignment tube and down into the filter tube, and where the tube flute plate and filter tube are moving down at the same rate as the plunger to prevent relative motion between the plunger and the filter tube.
Figure 9:
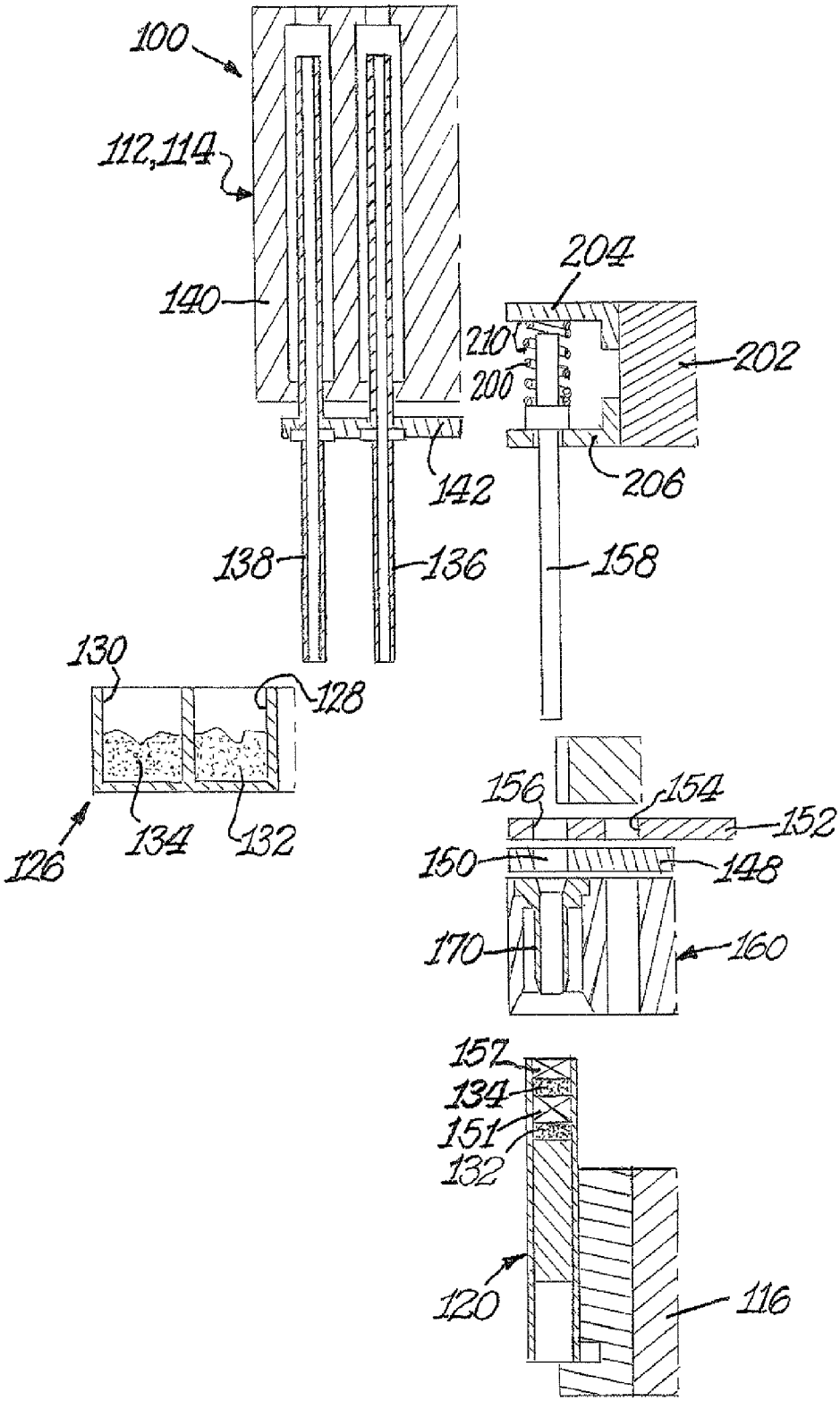
FIG. 9 is a diagrammatic sectional view where the tube flute plate and filter tube have moved axially down to their home position and the plunger has retracted up to its home position after pushing the contents of the assembly tube into the filter tube.

FIG. 8 illustrates the subsequent step, where the plunger moves further down to push the second (upper) filter segment portion 157, second granular material 134 and first (lower) filter segment portion 151 and first granular material 132, together as one, completely into the filter tube 120, such that the first granular materials 132 rest against the solid filter center 124 of the filter tube 120. When the filter segment portions 151, 157 exit the alignment tube 170, they expand slightly into engagement with the side walls of the filter tube 120. Gap 210A still exists because high force is still required to push the filling materials through the alignment tube 170. Also, due to the accuracy of the amount of granular material 132 and the cut length of the filter segment portions 151, 157, a possible gap could exist between the granular materials 132, 134 and the respective filter segment portions 151, 157. As the upper end of the upper filter segment portion 157 reaches the end of the alignment tube 170, the friction between the upper filter segment portion 167 and the side walls of the alignment tube 170 decreases and the compression spring begins to extend thereby forcing the segment portions 11, 157 to pack tightly against the respective granular materials 132, 134, as shown in FIG. 9, so as to create a fully filled condition within the filter tube. Once the filter segment portions 151, 157 are packed tightly against the respective granular materials 132, 134, a small gap may exist between the plunger collar 208 and the plunger guide bracket 206, depending upon the accuracy of the amount of granular materials 132, 134 and the cut length of the filter segment portions 151, 157. The tube flute plate 116 may move in a downward direction at the same speed as the filling materials 157, 134, 151, 132 in order to eliminate any significant relative frictional movement between the filling materials contents and the interior side walls of the filter tube 120. The integrity of the filter tube is thereby maintained. The plunger 158 then moves axially up to clear the second segment plate 152.

FIG. 9 illustrates the phase at which filling of the upper half of the filter tube 120 is complete. The tube flute plate 116 has moved down to a home position and the plunger 158 has retracted up to a home position. During this phase, the vacuum to the tube flute plate 116 is turned off, which allows the filter tube 120 to be removed from the upper wheel assembly 112 to the lower wheel assembly 114 for filling the other end of the filter tube.

In order for a multiple filled cavity filter to function properly, it is important that each granular dose be packed tightly, and that each solid filter segment be tight against the granular dose. As set forth in the preceding description, the compression spring 200 of each plunger 158 functions to ensure that the solid filter segments 151, 157 and the granular materials 132, 134 are tightly packed.

FIG. 24 the phase where the filter tube 120 has been filled on one end and the filter tube has returned to its home position. In order to fill the opposite end of the filter tube 120, a series of cylindrical and bevel transfer drums 162, 164 can be used to remove the filter tube from the upper (first) wheel assembly 112, flip it end for end and deposit the filter tube on the lower (or second) wheel assembly 114 which simply repeats the above steps described with respect to FIGS. 3-9. After traveling around second wheel assembly 114 the finished filter tube 120 with both ends filled is removed from the vertical filter filling machine 100 for testing and storage. The second wheel assembly 114 could be arranged to the side of the first wheel assembly 112, instead of below it, if desired.

In a preferred embodiment, each complete assembly wheel 112, 114 comprises fifteen (15) wheel assembly stations each with an arcuate extent of twenty-four degrees and centered about axis 118. Other embodiments may be constructed with different numbers of assembly wheel stations and different numbers of fill tubes, flutes and holes at each wheel assembly station.

Preferably, each wheel assembly 112, 114 includes a tube flute plate 116 which in the preferred embodiment has twelve (12) flutes along its arcuate perimeter. A same number of flutes are provided along the arcuate perimeter of the segment flute plate 144. Each wheel assembly further includes twelve (12) alignment tubes 170, twelve (12) fill tubes 136, twelve (12) fill tubes 138 and twelve (12) plungers 158. Holes in first and second segment plates 148 and 152, through which the filling materials pass, are also twelve (12)-count each for each assembly wheel station.

Each wheel assembly station includes twelve fill tubes 136 and 138, which for a given wheel assembly station are all supported by an independent slide system that is driven by an internal cam and lever system which imparts a predescribed axial (up and down) motion of the full tubes 136 and 138 as the wheel assembly is rotated through a complete cycle. Preferably, the fill tubes 136 and 138 do not move radially during a cycle.

Likewise, each wheel assembly station includes twelve plungers 158 that are similarly supported and controlled to execute their prescribed up and down motion per cycle.

Each wheel assembly station 112, 114 includes a second segment plate 152 which has an independent slide system that is driven by an internal cam which imparts a predescribed radial motion (in and out) as the respective wheel assembly is rotated through a complete cycle.

Preferably, the first segment plate 148 rotates about axis 118 without either radial or axial motion.

The tube flute plate 116 of each wheel assembly station is on an independent slide system and driven by a cam and lever to impart the prescribed axial motion (up and down) for the tube plate 116 as the respective assembly wheel station rotates through a complete cycle. The axial motion slides of the tube flute plate 116 and the alignment plate 160 are mounted on an independent slide system that is driven by an internal cam which imparts a predescribed concurrent radial motion (in and out) of tube flute plate 116 and the alignment plate 160 as the wheel assembly is rotated through a complete cycle.

As an alternative to filter storage, a tipping machine may be positioned to receive the finished filters as they are removed from the vertical fill machine 100. Wrapped tobacco rods are positioned at both ends of the finished filter and tipping paper is used to secure the rods to the filter. Cutting the filter in half produces two complete cigarettes. FIG. 25 illustrates an arrangement that includes a vertical fill machine 100 for producing multiple cavity dual filters, as explained above, and reference character 100 identifies a conventional tipping machine well known in the tobacco industry for taking dual filters and securing wrapped tobacco rods at the opposite ends of the filter with tipping paper. The thus formed tobacco/filter assembly is then cut in half at the solid filter center 124 at station 102 to produce two cigarettes each having a multiple cavity filter and a wrapped tobacco rod. U.S. Pat. No. 5,135,008 and published applications U.S. 2003/0131856 A1 and U.S. 2005/094014 A1 illustrate and describe tipping machines and these documents are incorporated herein by reference in their entirety for all useful purposes.

FIGS. 10-23 illustrate an alternative embodiment of the inventive machine and process. In this embodiment, the machine and process employ a hollow assembly tube 370, a perforated upper plunger 358 and a lower plunger 398. The upper plunger 358 has an open upper end and a perforated lower end, which allow vacuum applied to the upper end to draw through the assembly tube 370 and its contents. The assembly tube 370 and upper and lower plungers 358, 398 are employed instead of the fill tubes, plunger and alignment tube used in the embodiment illustrated in FIGS. 2-23. The assembly tube 370, perforated upper plunger 358 and lower plunger 398 may be supported on rotating and translating members in similar fashion to the fill tubes, plunger and alignment tube of the previous embodiment, with modifications being made as necessary to achieve the desired movements. Furthermore, the upper and lower plungers 358, 398 may be spring biased in a manner similar to that of the plungers in the previous embodiment in order to promote tight packing of the filter tubes.

Figure 10:
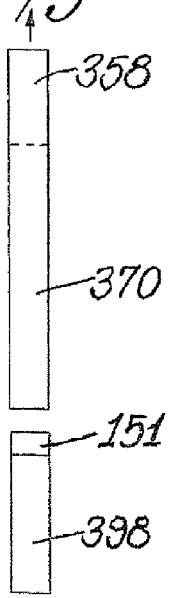
FIG. 10 is a diagrammatic view of an alternative embodiment including a hollow assembly tube, a lower plunger and a perforated upper plunger for inserting filter materials into a filter tube, where the assembly tube is aligned with the lower plunger in preparation for pushing the lower filter segment into the assembly tube.

FIG. 10 shows an assembly step where the upper plunger 358 is inserted through the top of the assembly tube 370 and the assembly tube is aligned with the lower plunger 358 in preparation for pushing a first filter segment 151 into the assembly tube 370. As can be seen in FIG. 10, the lower plunger 398 is positioned below the bottom end of the assembly tube 370 and the first filter segment 151 is located against the end of the lower plunger 398.

Figure 11:
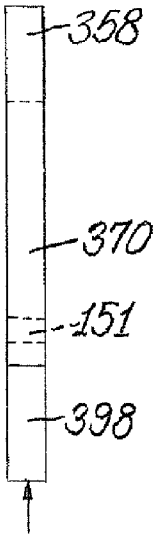
FIG. 11 is a diagrammatic view of the alternative embodiment where the lower plunger is moving up to push the lower filter segment up into the assembly tube.
Figure 12:
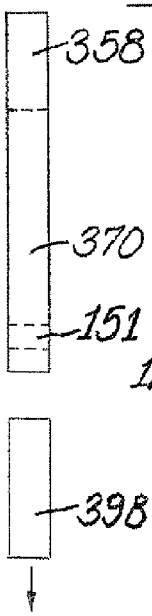
FIG. 12 is a diagrammatic view of the alternative embodiment where the lower plunger is moving down and out of the assembly tube after inserting the lower portion of the cut filter segment into the assembly tube.

FIG. 11 shows a subsequent assembly step in which the lower plunger 398 is moving up and pushing the first filter segment 151 into the assembly tube 370 through the bottom end of the assembly tube. The first filter segment 151 is pushed to a location which allows enough space below for granular/flowable material to occupy. After pushing the first filter segment 151 into the assembly tube 370, the lower plunger 398 moves down and out of the assembly tube (FIG. 12).

Figure 13:
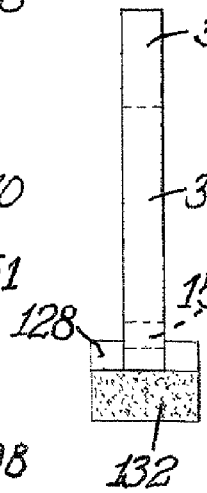
FIG. 13 is a diagrammatic view of the alternative embodiment where the upper plunger and assembly tube have moved out and down such that the assembly tube is inside the inner trough of the granule bin.
Figure 14:
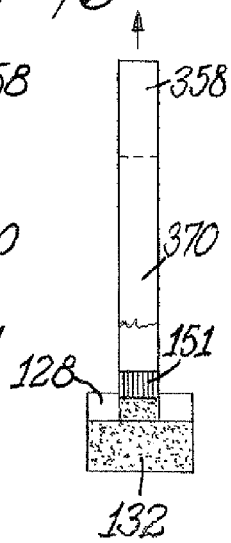
FIG. 14 is a diagrammatic, partially sectional view of the alternative embodiment where vacuum is applied through the upper plunger, thereby suctioning granular material from the inner trough of the granule bin into the assembly tube.

In a following step, shown in FIG. 13, the upper plunger 358 and assembly tube 370 move out and down so as to place the assembly tube 370 in the inner trough 128 of the granule bin. In this position, the upper plunger 358 is prepared to draw the first granular material 132 from the inner trough 128 into the assembly tube 370. Thereafter, as shown in FIG. 14, vacuum is applied to the top end of the upper plunger 358, thereby suctioning the first granular material 132 from the inner trough 128 into the assembly tube 370 and against the first filter segment 151.

Figure 15:
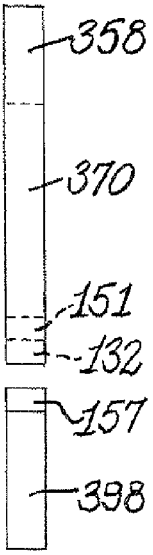
FIG. 15 is a diagrammatic view of the alternative embodiment where the granular material from the inner granule bin has been suctioned into the assembly tube, and the upper plunger and assembly tube have moved up so as to remove the assembly tube from the inner trough and then inward into alignment with the lower plunger in preparation for pushing the upper filter segment into the assembly tube.
Figure 16:
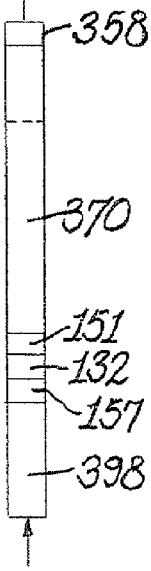
FIG. 16 is a diagrammatic view of the alternative embodiment where the upper plunger and lower plunger are moving up to push the upper filter segment up into the assembly tube.
Figure 17:
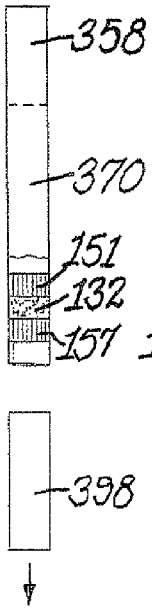
FIG. 17 is a diagrammatic, partially sectional view of the alternative embodiment where the lower plunger is moving down and out of the assembly tube after inserting the upper filter segment into the assembly tube.

In the next step of the operation, shown in FIG. 15, the upper plunger 358 and the assembly tube 370 move up and subsequently inward so as to lift the assembly tube 370 out of the inner trough 128 and place the upper plunger 358 and assembly tube 370 into alignment with the lower plunger 398. At this point, the assembly tube 370 is prepared for the lower plunger 398 to push a second filter segment 157 into the assembly tube 370. During these movements, vacuum through the upper plunger 358 is maintained in order to retain the first granular material 132 in the assembly tube 370. Thereafter, as shown in FIG. 16, vacuum through the upper plunger 358 continues to be applied and the lower plunger moves up to push the second filter segment 157 through the bottom end of the assembly tube 370 and into the assembly tube 370 against the first granular material 132, leaving room below for additional granular/flowable material. After the second filter segment 157 has been placed in the assembly tube 370, vacuum through the upper plunger 358 may be discontinued, and the lower plunger 398 moves down and out of the assembly tube 370 (FIG. 17).

Figure 18:
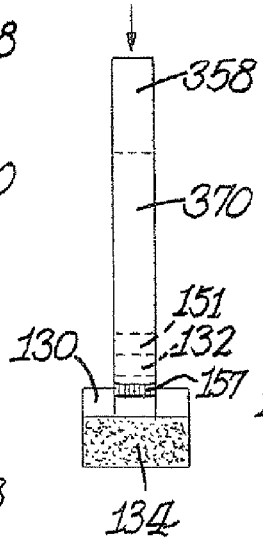
FIG. 18 is a diagrammatic, partially sectional view of the alternative embodiment where the upper plunger and assembly tube have moved out and down such that the assembly tube is inside the outer trough of the granule bin.
Figure 19:
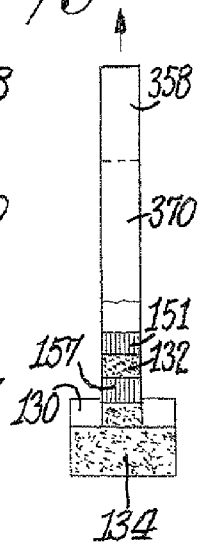
FIG. 19 is a diagrammatic, partially sectional view of the alternative embodiment where vacuum is applied through the upper plunger, thereby suctioning granular material from the outer trough of the granule bin into the assembly tube.

Subsequently, as shown in FIG. 18, the upper plunger 358 and assembly tube 370 move out and down so as to place the assembly tube 370 in the outer trough 130 of the granule bin. In this position, the upper plunger 358 is prepared to draw the second granular material 134 from the outer trough 130 into the assembly tube 370. Thereafter, as shown in FIG. 19, vacuum is applied to the top end of the upper plunger 368, thereby suctioning the second granular material 134 from the outer trough 130 into the assembly tube 370 and against the second filter segment 157.

Next, as shown in FIG. 20, the upper end of a filter tube 120 is fitted onto the lower end of the assembly tube 370 from below. During this time, vacuum through the upper plunger 358 is maintained in order to retain the second granular material 134 in the assembly tube 370. Thereafter, as shown in FIG. 21, the upper plunger 358 moves down through the assembly tube 370 and the filter tube 120 moves down at the same rate, so that the filling materials 132, 151, 134, 157 are pushed out of the assembly tube 370 and packed tightly into the filter tube such that the second granular material 134 is against the solid filter center 124 of the filter tube. After the filling materials 132, 151, 134, 157 have been tightly packed in the filter tube 120, the upper plunger 358 moves up out of the assembly tube 370, as shown in FIG. 22. As illustrated in FIG. 23, assembly tube 370 is thereafter lifted out of the filter tube 120 and filling of the upper half of the filter tube 120 is complete. The filter tube 120 can then be inverted and the above process can be repeated to fill the lower half of the filter tube 120.

The embodiment of FIGS. 10-23 provides for tight packing of filling materials in the filter tube by eliminating gaps between the filling materials. The integrity of the filter tubes is also preserved by minimizing relative motion between the filling materials and the filter tube as the filling materials are placed in the filter tube. Furthermore, this embodiment provides for precise metering of the granular filter materials by allowing fill amounts to adapt to variations in the lengths of the filter segments in the filter tubes.

It should be understood that the above detailed description while indicating preferred embodiments of the invention are given by way of illustration only since various changes and modifications within the spirit and scope of the invention will become apparent to those skilled in the art from the detailed description. For example, an alternative embodiment may comprise a linear and/or endless belt configuration that is arranged to execute assembly steps that are equivalent to those of the rotary configuration of the preferred embodiments.

I claim:

1. A process of producing a compound cigarette filter comprising:

placing a filter tube having hollow ends and a solid filter center in a substantially vertical position;

placing a first open end of the filter tube over an alignment tube such that the solid filter center rests against the bottom edge of the alignment tube;

withdrawing by suction a predetermined amount of a first material from a source of the first material;

depositing the predetermined amount of the first material into the alignment tube directly against the solid filter center;

placing a first solid filter segment into the upper open end of the alignment tube directly against the predetermined amount of the first material, said predetermined amount of the first material and said first solid filter segment constituting filling materials; and pushing said filling materials, together as one, out of the alignment tube and into the first open end of the filter tube so as to avoid relative movement between the filling materials and the interior walls of the filter tube.

2. A process of producing a compound cigarette filter comprising:

placing a hollow assembly tube in a substantially vertical position;

moving a lower plunger up to push a first solid filter segment into the assembly tube through a bottom end of the assembly tube;

inserting a hollow upper plunger having a perforated end into a top end of the assembly tube;

applying vacuum through said upper plunger to draw a first material out of a source of the first material into the bottom end of said assembly tube against said first solid filter segment, said first solid filter segment and said first material constituting filling materials;

placing a top end of a hollow filter tube over the bottom end of said assembly tube; and moving said upper plunger to push said filling materials, together as one, out of said assembly tube and into an upper open end of said filter tube against a solid filter center of the filter tube so as to avoid relative movement between said filling materials and the interior walls of said filter tube.

3. An apparatus for producing compound cigarette filters comprising:

a rotating tube flute plate for holding and transporting a plurality of filter tubes along a circular path, each filter tube having hollow ends and a solid filter center, with the filter tubes in vertical orientation;

a rotating alignment plate for holding and transporting a plurality of hollow open-ended alignment tubes for receiving a first open end of said filter tubes thereover;

a rotating bin containing a first material;

a plurality of vertically-oriented rotating fill tubes with suction applied thereto for withdrawing predetermined amounts of the first material from the rotating bin and depositing one of said predetermined amounts of the first material into each of said alignment tubes upon termination of the suction;

a rotating filter segment plate for holding a plurality of first solid filter segments; and a plurality of rotating plungers arranged to vertically push the first solid filter segments out of the filter segment plate into the alignment tubes with one of said first solid filter segments directly against the one of said predetermined amounts of the first material in each of said alignment tubes, wherein said one of said predetermined amounts of the first material and said one of said first solid filter segments in each of said alignment tubes constitute a unit of filling materials, and wherein said rotating plungers are arranged to push said unit of filling materials in each of said alignment tubes out of each of said alignment tubes and into a first end of a respective one of said filter tubes so as to avoid relative movement between said filling materials and the interior walls of said filter tubes.

4. An apparatus as in claim 3 wherein the first material is granular.

5. An apparatus for producing compound cigarette filters as in claim 3 further comprising:

a second plurality of vertically-oriented rotating fill tubes with suction applied thereto for withdrawing predetermined amounts of a second material from the rotating bin and depositing one of said predetermined amounts of said second material into each of said alignment tubes directly against said one of said first solid filter segments upon termination of the suction;

a rotating second filter segment plate for holding a plurality of second solid filter segments; wherein the plurality of rotating plungers vertically push the second solid filter segments out of the second filter segment plate into the alignment tubes with one of said second solid filter segments directly against said one of said predetermined amounts of the second material in each alignment tube, and wherein said one of said predetermined amounts of the second material and said one of said second solid filter segments in each of said alignment tubes also constitute the unit of filling materials.

6. An apparatus as in claim 5 wherein the first and second materials are granular.

7. An apparatus for producing compound cigarette filters as in claim 5 wherein the rotating bin includes two compartments, one for each of the first and second materials.

8. An apparatus for producing compound cigarette filters as in claim 5 further comprising:

a segment flute plate for holding a plurality of extended length solid filter segments; and a rotating cutter moveable between the first segment plate and the second segment plate for cutting the extended length solid filter segment after positioning thereof in the solid segment plate and second segment plate to thereby form the first solid filter segments and the second solid filter segments.

9. An apparatus for producing compound cigarette filters as in claim 5 wherein the rotating tube flute plate, the rotating bin of material, the plurality of vertically oriented fill tubes and second fill tubes, the first segment plate and second segment plate, and the plurality of rotating plungers collectively comprise an upper wheel assembly rotating about a central vertical axis, said apparatus further comprising:

a lower wheel assembly substantially identical to the upper wheel assembly also rotating about the central vertical axis; and means for removing half-filled filter tubes from the upper wheel assembly, inverting the half-filled filter tubes and placing them on a rotating tube flute plate of the lower wheel assembly; whereby second ends of the filter tubes are filled with material and solid filter segments on the lower wheel assembly.

10. An apparatus for producing compound cigarette filters as in claim 5 wherein the solid filter center of each filter tube and the first solid filter segments and second solid filter segments comprise cellulose acetate tow.

11. An apparatus for producing compound cigarette filters as in claim 10 in combination with a tipping machine immediately downstream therefrom constructed and arranged to combine wrapped tobacco rods, one at each end of a finished filter, and a cutter for severing each filter at its midpoint to form two complete cigarettes.

12. An apparatus for producing compound cigarette as in claim 5 wherein each of the plungers is spring-biased and arranged to insure that said one of said first solid filter segments and said one of said second solid filter segments are solidly positioned against said one of said predetermined amounts of the first material and said one of said predetermined amounts of the second material, respectively, so as to create a fully filled condition within each of said filter tubes.

13. An apparatus for producing compound cigarette filters comprising:

a rotating tube flute plate for holding at least one vertically-oriented filter tube, said at least one filter tube including a solid filter center;

a first rotating segment plate for holding at least one first solid filter segment;

a material source containing a first material;

at least one vertically-oriented assembly tube corresponding to said at least one filter tube, said at least one assembly tube being arranged to receive a corresponding unit of filling materials;

at least one lower plunger corresponding to said at least one assembly tube, wherein said at least one lower plunger moves up to push said at least one first solid filter segment into said at least one assembly tube from below; and at least one hollow upper plunger corresponding to said at least one assembly tube, said at least one upper plunger having a perforated bottom end, wherein said at least one upper plunger is inserted into said assembly tube from above and vacuum is applied through said at least one upper plunger to draw an amount of said first material out of said material source into said at least one assembly tube and against said at least one first solid filter segment, said amount of said first material and said at least one first solid filter segment constituting said unit of filling materials;

wherein, after said unit of filling materials has been placed in said at least one assembly tube, said at least one assembly tube moves down and is inserted into an upper open end of said at least one filter tube and said at least one upper plunger moves down to push said unit of filling materials out of said at least one assembly tube and into said at least one filter tube against said solid filter center so as to avoid relative movement between the filling materials and the interior walls of the filter tube.

14. An apparatus as in claim 13 wherein the first material is granular.

15. An apparatus as in claim 13 further comprising:

a second rotating segment plate for holding at least one second solid filter segment; and a second material contained within said material source;

wherein: said at least one lower plunger moves up to push said at least one second solid filter segment into said at least one assembly tube and against said amount of said first material from below; and vacuum is applied through said at least one upper plunger to draw an amount of said second material out of said material source into said at least one assembly tube against said at least one second solid filter segment, said amount of said second granular material and said at least one second solid filter segment also constituting said unit of filling materials.

16. An apparatus as in claim 15 wherein said first and second materials are granular.

17. An apparatus for producing compound cigarette filters as in claim 15 wherein the material source includes a rotating bin having at least one compartment for each of said first material and said second material.

18. An apparatus as in claim 15 wherein the rotating tube flute plate, the rotating bin, at least one lower plunger, the at least one assembly tube, the at least one upper plunger, and the rotating first filter segment plate and second filter segment plate collectively comprise an upper wheel assembly rotating about a central vertical axis, said apparatus further comprising:

a lower wheel assembly substantially identical to the upper wheel assembly also rotating about the central vertical axis; and means for removing half-filled filter tubes from the upper wheel assembly, inverting the half-filled filter tubes and placing them on a rotating tube flute plate of the lower wheel assembly; whereby second ends of the filter tubes are filled with material and solid filter segments on the lower wheel assembly.

19. An apparatus as in claim 15 wherein the solid filter center of said at least one filter tube, the at least one solid first filter segment and the at least one second solid filter segment comprise cellulose acetate tow.

20. An apparatus for producing compound cigarette filters as in claim 19 in combination with a tipping machine immediately downstream therefrom constructed and arranged to combine wrapped tobacco rods, one at each end of a finished filter, and a cutter for severing each finished filter at its midpoint to form two complete cigarettes.

21. An apparatus as in claim 15 wherein said at least one lower plunger and said at least one upper plunger are spring-biased and arranged to insure that said filling materials are tightly packed together so as to create a fully-filled condition within the filter tube.

22. An apparatus for producing compound cigarette filters as in claim 15 further comprising:

a segment flute plate for holding at least one extended length solid filter segment; and a rotating cutter moveable between said first segment plate and said second segment plate for cutting the at least one extended length solid filter segment after positioning thereof in the first solid segment plate and second solid segment plate to thereby form said at least one first solid filter segment and said at least one second solid filter segment.

* * * * *